United States Patent [19]

Alford et al.

[11] Patent Number: 4,554,552

[45] Date of Patent: Nov. 19, 1985

[54] ANTENNA FEED SYSTEM WITH CLOSELY COUPLED AMPLIFIER

[75] Inventors: James L. Alford; Robert E. Terry, both of Rancho Palos Verdes, Calif.

[73] Assignee: Gamma-f Corporation, Torrance, Calif.

[21] Appl. No.: 333,016

[22] Filed: Dec. 21, 1981

[51] Int. Cl.[4] ..... H01Q 13/02

[52] U.S. Cl. ..... 343/786; 343/840; 455/293

[58] Field of Search ..... 343/786, 779, 797, 756, 343/783, 872, 702, 781 CA, 772, 781 R, 781 P, 784, 840; 455/280, 281, 293; 358/86

[56] References Cited

U.S. PATENT DOCUMENTS

| | | | |
|---|---|---|---|
| 2,825,060 | 2/1958 | Ruze | 343/786 |
| 2,850,705 | 9/1958 | Chait et al. | 343/783 |
| 2,954,557 | 9/1960 | Yang | 343/786 |
| 3,458,862 | 7/1969 | Franks | 343/786 |
| 3,832,717 | 8/1974 | Taggart, Jr. | 343/840 |
| 3,931,624 | 1/1976 | Hundley et al. | 343/840 |
| 3,938,157 | 2/1976 | Brickey | 343/756 |
| 4,195,302 | 3/1980 | Leupelt | 343/781 CA |
| 4,290,068 | 9/1981 | Bogner | 343/785 |

FOREIGN PATENT DOCUMENTS

| | | | |
|---|---|---|---|
| 1219872 | 1/1971 | United Kingdom | 343/786 |

OTHER PUBLICATIONS

McClannan et al., "A Satellite System for CATV", Proceedings of the IEEE, vol. 58, No. 7, Jul. 1970, pp. 987–1001.

*Primary Examiner*—Eli Lieberman
*Assistant Examiner*—Michael C. Wimer
*Attorney, Agent, or Firm*—Fraser and Bogucki

[57] ABSTRACT

A compact antenna feed system for orthogonally polarized RF signals includes a waveguide feed having orthogonally disposed internal ridges, a pair of wave detectors coupled to the waveguide feed to receive orthogonally oriented RF signals, and an amplifier housed as part of the feed system to amplify received RF signals prior to communication of the signals outside the feed system. The system is readily switchable by remote control to receive RF signals in either orientation and angular alignment to the orientation of the incoming signals is easily accomplished.

6 Claims, 6 Drawing Figures

ANTENNA FEED SYSTEM WITH CLOSELY COUPLED AMPLIFIER

BACKGROUND OF THE INVENTION

This invention relates to antenna feed systems, and more particularly to systems for deriving individual signals from a number of signals received within a given band at an antenna system, which signals may be subject to adjacent channel interference.

The rapidly growing use of localized antenna systems for recieving signals from communications satellites has directed increasing attention to improvement of the cost and performance of these systems. Problems have arisen in obtaining the proper signal-to-noise ratio because adjacent or co-channel interference can become excessive, and can only be eliminated in the prior art by the use of specialized or expensive waveguide transmission or amplification equipment.

In satellite communication signals that are devoted to television transmissions, for example, an available frequency band (e.g. 3.7 to 4.2 GHz) is divided into 12 or 24 different channels, each channel of 36 MHz bandwidth occupied by different transmissions, such as one television and two audio carriers or subcarriers. The constraints on the transmitting system, the satellite, are fixed in that only a limited amount of power is available for concurrent transmission of all of these signals. The constraints on the receiving system then arise both from performance and cost considerations. To receive a high quality television picture, for example, it is required to have a signal-to-noise ratio of approximately 40 db on reception. External noise is combated by using frequency modulation with threshold extension, although other techniques are also available, and internal noise at the receiving end is minimized through the use of low noise amplifiers. The systems have become economically feasible for widespread use because of the development of GaAsFET devices, which cost far less than the parametric amplifiers and similar systems that would otherwise have to be used. Even using GaAsFETs, the signal-to-noise ratio is still marginal, so co-channel noise is combated by the use of crosspolarization of adjacent channels in 24 channel satellites since adjacent channels are spaced 20 MHz apart. Crosspolarization, however, introduces its own penalties in the form of a need to distinguish between polarizations, whether amplifying one selected channel by itself, or amplifying all of the channels concurrently. The techniques heretofore available for providing polarization selectivity have heretofore introduced unwanted expense or unreliability, or both, into the systems.

It was recognized early that cross-polarized signals in different channels received at a microwave antenna could be separately extracted by using an antenna feed comprising a feed waveguide, a polarization responsive waveguide junction, and output waveguide structures coupling from the waveguide junction to associated amplifiers. The components used in this system are not only expensive, but extremely bulky and cumbersome, so that when used as a prime focus feed relative to a parabolic antenna they are both much bigger and much heavier than desirable. In addition, their angle of rotation relative to incident polarized energy cannot be changed except by the use of a large and heavy mounting. Consequently, other systems are also currently in use. One approach is to use only a single polarization feed, so that only one of the two alternate sets of channels can be received. An obvious variation that is also used is to employ a single polarization feed and to physically rotate the feed through 90° in order to switch between sets of channels. It was also recognized that an equivalent result could be obtained more conveniently by mounting the feed on a standard antenna rotor that could be remotely controlled. Such an arrangement is quite slow and because the large units must be exposed to the weather, they tend to experience corrosion and mechanical difficulties and therefore have proven to be quite unreliable.

Other physical and electrical requirements of these systems must also be borne in mind. The feed that is typically employed is a prime focus feed, mounted at the focal point of a parabolic reflector of 3–4 meters or more in diameter. The Cassegranian-type feed is also used. In either event, it is desirable for low noise amplifiers to be at the feed itself. Thus, transmission line losses in a relatively long line coupling to an adjacent facility where processing equipment is located are not apt to present a problem. Further, any of a number of different combinations of channel selection, conversion and receiver equipment, may be used and the antenna feed system should be readily adaptable. Systems heretofore known have not permitted this versatility in a price range that is suitable for the current users of these communications channels.

In addition to the art mentioned above, it is noted that complex amplification systems have been used for cancelling cross-polarization interference, as evidenced by U.S. Pat. No. 4,283,795. Horns having internal ridges are being used for transmission of cross-polarized signals at high power levels to different ones of the receiving systems mentioned above. Such arrangements do not, singly or in combination, suggest the manner in which a superior antenna feed system overcoming the problems of the prior art may be provided.

SUMMARY OF THE INVENTION

An antenna feed system in accordance with the invention for receiving signals from alternately orthogonally polarized transmissions in adjacent channels in a frequency band utilizes a compact housing structure and an internal waveguide structure mounted at an antenna focal region. A feed waveguide, preferably rotatable through an angle with respect to the housing, includes an internal ridged structure and a pair of orthogonally disposed probe means. The probe means is coupled directly to an amplifier system mounted between the waveguide and the housing. With this arrangement, wave energy is propagated within the waveguide in two preferred directions of polarization, with good isolation between them. Furthermore, the wave energy of each polarization direction is transferred out to closely coupled amplifier means, with minimum signal attenuation. The amiplifer means may comprise either a pair of preampliziers that may be alternatively coupled by an externally controllable switching device to a single low noise amplifier, or a pair of low noise amplifiers in parallel that provide all-channel amplification. Side lobe beams are suppressed by disposing a number of concentric rings about the input section of the waveguide. Another feature is that the waveguide may be adjusted through a small rotation angle relative to the housing, so as to be set at the optimum angle relative to the remote source of transmissions. This antenna feed system therefore provides a light weight, low cost and highly versatile arrangement that can be adapted to a wide variety of configurations of the associated electronics.

BRIEF DESCRIPTION OF THE DRAWINGS

A better understanding of the invention may be had by reference to the following description, taken in conjunction with the accompanying drawings, in which.

DETAILED DESCRIPTION OF THE INVENTION

Figure 4:
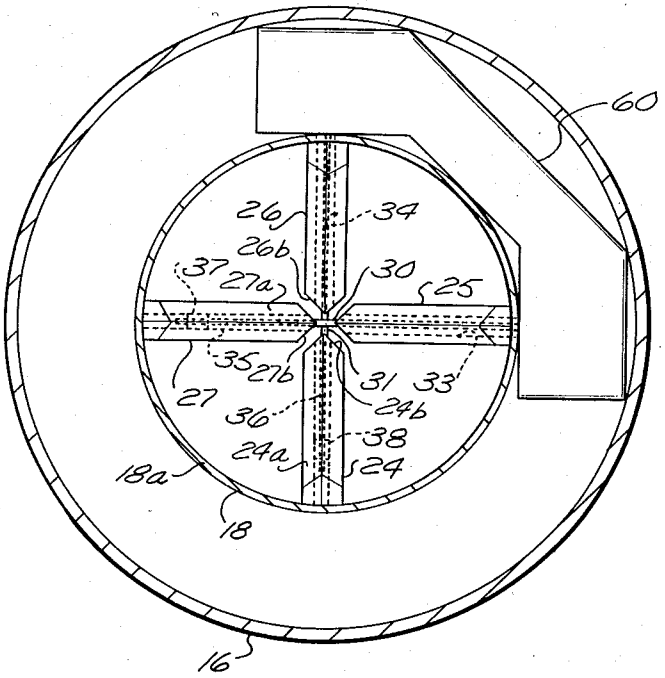
FIG. 4 is a broken away end view of the arrangement of FIG. 2.
Figure 1:
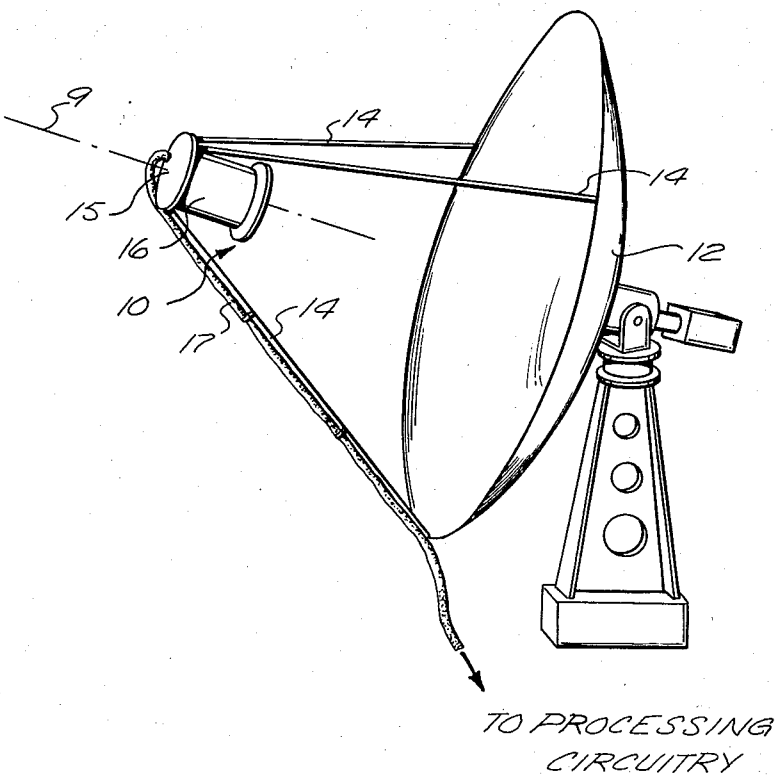
FIG. 1 is a perspective view of an antenna feed in accordance with the invention as used in conjunction with a parabolic reflector.

An antenna feed system in accordance with the invention, referring now to FIGS. 1–4, may employ a feed system 10, including amplifiers, as a prime focus feed for a large parabolic reflector antenna 12. Support rods 14 coupled to spaced apart points on the edge of or other appropriate points on the antenna 12 extend to the focal region to maintain the feed system 10 in position in the focal region. The extending ends of the support rods 14 are coupled to a back flange 15 on a cylindrical housing 16 within which the elements of the antenna feed system 10 are disposed. Shielded cable or cables 17 provide a coupling from the antenna feed 10 along one of the support rods 14 to associated processing circuitry, and also couple a voltage source (not shown) to the feed system 10 to provide power for the internal circuitry that is employed.

Figure 5:
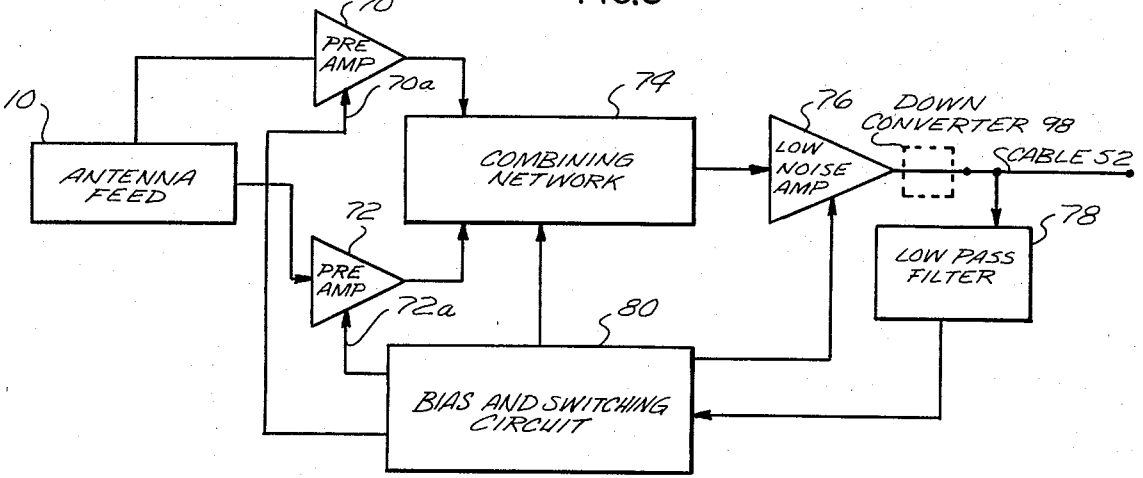
FIG. 5 is a block diagram of one circuit arrangement that may be employed in the system of FIGS. 1–4.

The present example, which is described in conjunction with the circuitry of FIG. 5, assumes that 24 different 36 MHz channels, with adjacent channels cross-polarized relative to each other 90° apart, are to be received, and that either polarization set may be selected for coupling onto a single output conductor. This is to be accomplished with equal sensitivity for each of the directions of polarization and with minimum co-channel intererence.

Figure 2:
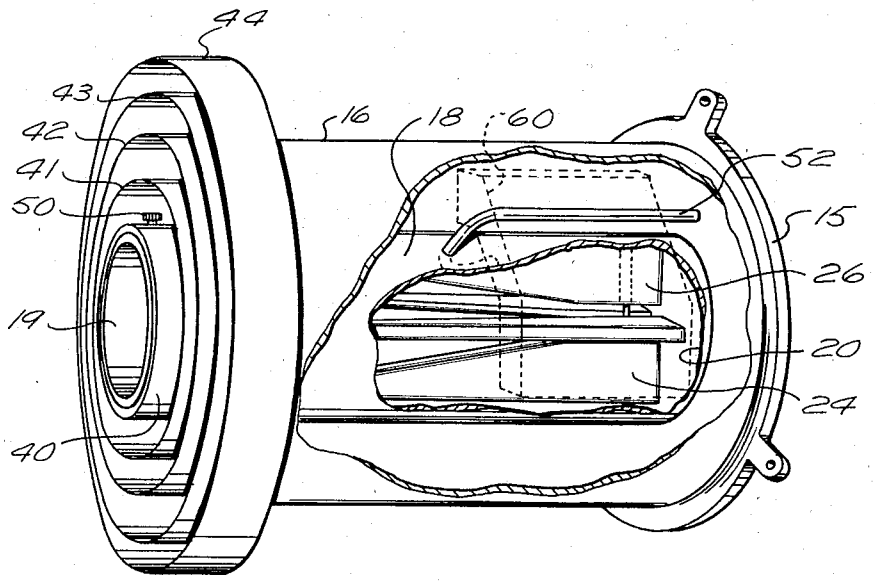
FIG. 2 is a combined perspective view, partially broken away, and a block diagram view of the principal elements of a feed system in accordance with the invention.
Figure 3:
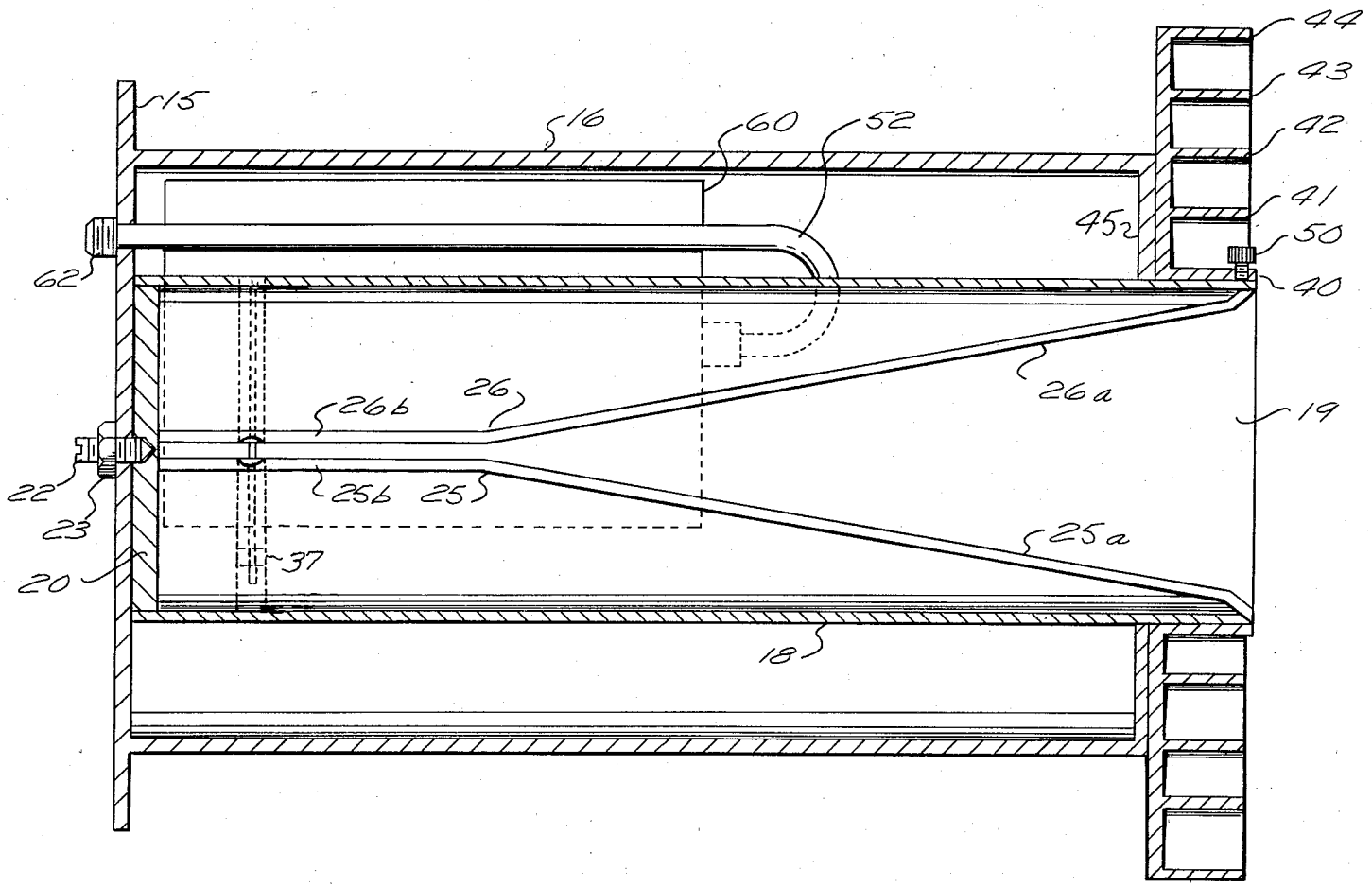
FIG. 3 is a cross-sectional side view of the waveguide elements of the system of FIG. 2.

The details of the wave receiving and guiding structure are seen in the views of FIGS. 2–4 and include a circular waveguide 18 disposed about a central, longitudinal axis 9 and defined by a cylindrical wall 18*a* having an electrically open input end 19 which is centrally mounted to receive incident wave radiation (a conventional cover that is transparent to wave energy but keeps out moisture and foreign matter has not been shown). A transverse wall 20, adjacent the opposite output end of the waveguide 18, serves as an electrical short. Alternatively, the waveguide 18 may have a square cross-sectional shape.

A screw 22 threaded into the end wall 20 of the waveguide 18 and extending through a hole in the facing wall of the housing 16 provides a central registration point for the closed end of the waveguide 18. A lock nut 23 on the outside of the housing 16 may be tightened to provide firm engagement or loosened to permit angular rotation of the waveguide 18 through an adequate angle for best reception, dependent upon the optimum azimuth angle relative to the cross-polarized signals.

Within the waveguide four relatively thin, planar plate-like internal ridges 24, 25, 26 and 27 are disposed in separate quadrants and in orthogonal relationship to adjacent ridges and extend radially inward from the waveguide wall 18*a* toward the central axis 9. The ridges 24–27 have tapered transformer sections 24*a*–27*a* that are of minimal height adjacent the input end 19 and gradually increase in height (toward the central axis 9), leveling off at a constant maximum height section 24*b*–27*b* adjacent the closed output end. Although tapered transformer sections are shown it will be recognized by those skilled in the art that stepped or curved transitions may alternatively be used.

Adjacent the output end of the waveguide 18 the constant height sections 24*b*–27*b* of the internal ridges 24–27 are separated by a predetermined spacing. In two orthogonally disposed ridges, such as ridges 25 and 26, transverse probes 30, 31 extend coaxially from the base to the tops of the constant height sections through small apertures 33, 34 near the closed output end of waveguide 18 and perpendicular to central axis 9. The probes 30, 31 extend beyond ridges 25 and 26 past central axis 9 and into apertures 35, 36 within ridges 27 and 24. Dielectric mounting elements 37, 38 are disposed within apertures 35, 36 to mountingly receive probes 30, 31 and maintain the probes 30, 31 in spaced relationship to the walls of the apertures 33, 35 and 34, 36. The probes 30, 31 couple to and are excited by electromagnetic wave energy in the waveguide 18. The constant height regions of the ridges 24–27 function selectively to enhance the polarized wave energy and improve the isolation between cross-polarized fields while the transformer sections provide impedance matching between incident wave energy and coaxial probes 30 and 31.

Adjacent the input end 19 of the waveguide 18, a series of five concentric suppressor rings 40, 41, 42, 43 and 44 are mounted on an annular end plate 45 that is inwardly directed to join the outer waveguide wall at a point spaced a short distance from the input end 19 toward the output end. The suppressor rings 40–44 are of progressively larger diameters and function to suppress side lobe antenna patterns without inducing reflections within the waveguide 18. A set screw 50 threaded through the innermost ring 40 near the open end of the waveguide 18 can be tightened to hold the waveguide 18 in any chosen angular position.

The outer diameter of the waveguide 18, in its intermediate region, is spaced apart from the inner diameter of the housing 16 by a sufficient distance to accommodate electronic amplifier and other components. Within this space, as best seen in FIGS. 2 and 4, are mounted an amplifier housing 60 and a shielded cable 52 which is coupled to an external output connector 62. The cable 52 is sufficiently long and flexible to accommodate any required adjustment of the waveguide 18 by rotation with respect to the housing 16. The amplifier housing 60 is configured so as to be partially wrapped about a portion of the circular waveguide 18, this arrangement being convenient for both assembly and mounting purposes. It will also be evident that different functional units may be separately housed and mounted within the available space. In the present arrangement, however, all units are maintained in close proximity to the feed system, are easily mounted in position, are electrically isolated from external equipment, and are protected from the weather.

The circuits contained within the amplifier housing 60 are those shown in the arrangement depicted in FIG. 5. The two orthogonally polarized signals from probes 30, 31 of the antenna feed 10 are coupled respectively to preamplifiers 70, 72. Only one preamplifier 70 or 72 is activated at a time by a control signal on a conductor 70*a* or 72*a* to couple its output to a combining network 74 from which the signal is applied to a low noise GaAs-FET amplifier 76, in this example. The output from the amplifier 76 is coupled to the conductive cable 52 and contains the selected set of incident signal channels received by the antenna 12. A down converter 98 may be optionally coupled between the output of amplifier 76 and cable 52. DC power input and intermittent switching control signals are provided to this electronic system along the external and internal shielded conductors which form cable 52 and passed by a low pass filter 78 to a bias and switching circuit 80 which controls the first and second preamplifiers 70, 72. Because switching is only momentary and done infrequently, the presence of switching waveforms on the line does not disrupt program reception.

The system of FIGS. 1–5 is far smaller and much less costly than prior antenna feed systems having selectivity to the direction of polarization of incident wave energy. The unit is so light and compact that it may be installed and adjusted by a single individual, and without requiring high sensitivity. Using the switching feature of FIG. 5, the system provides non-simultaneous dual polarization that is directly adapted for use with many existing types of systems that currently employ other kinds of antenna feeds. By employing electronic polarization separation within the system, a polarization isolation of 35 db minimum is obtained, with a feed loss of less than 0.1 db maximum. Because the feed is integrated with the low noise amplifier, the use of a minimum number of connections and a minimum input path length achieved through direct electrical connection between the inputs of the preamplifiers 70, 72 and probes 30, 31 assures lower composite noise figure than prior art systems such as 1.5 db maximum for the 3.7 to 4.2 GHz range. Typical commercial GaAsFET low noise amplifiers can operate with a 12 or 20 volt DC energizing source and require a 150 milliampere current drain.

Figure 6:
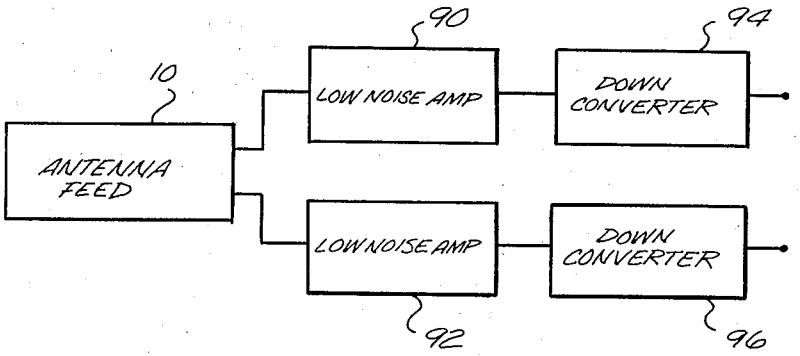
FIG. 6 is a block diagram of a different circuit arrangement for use in conjunction with the system of FIGS. 1–4.

The electronic amplifier system of FIG. 6 operates over the same frequency band, with like feed loss, polarization isolation and noise characteristics, but as seen in FIG. 6 incorporates a pair of low noise amplifiers 90, 92. Because both sets of channels are amplified concurrently, separate outputs are provided which may or may not be mixed, depending upon system applications. In the example of FIG. 6, each set of signals is fed to a different down converter 94, 96, respectively. The down converters 94, 96 receive control signals in conventional fashion well known in the cable television industry to mix the incoming high frequency signals with a variable reference frequency. Thus the outputs of the down converters provide difference signals in an intermediate frequency band or can select one channel for conversion to a preselected single intermediate frequency. The primary characteristic of this FIG. 6 system that differs from those previously discussed is that current must be supplied for both amplifiers simultaneously.

Although various forms and configurations of structures in accordance with the invention have been described, it will be appreciated that the invention is not limited thereto but encompasses all modifications and variations falling within the scope of the appended claims.

What is claimed is:

1. A system for cooperation with a microwave antenna that receives signals in a group of channels, with the signals in adjacent channels being cross-polarized relative to each other, for passing amplified signals to associated processing equipment with low interference between the cross-polarized channels, comprising:

a waveguide feed coupled to the antenna and responsive to wave energy focused thereby, the waveguide feed comprising a waveguide of circular cross section disposed along a central axis and having an input end and an output end, the waveguide including means defining an electrical short across the output end, a wall and a plurality of internal orthogonally disposed ridges mounted within the wall to define orthogonal planes of preferred mode wave propagation, the internal ridges being of decreasing height in a direction toward the input end;

first and second orthogonally disposed probes coupled to the waveguide feed, each of the probes extending into the internal waveguide ridges to transmit wave energy from the waveguide, being in alignment with a different preferred propagation plane and extending through the wall of the waveguide feed with vertically polarized waves being detected at the first probe and horizontally polarized waves being detected at the second probe;

a housing disposed about the waveguide;

amplifier means mounted between the waveguide and the housing and directly connected to the probe means with no waveguide intermediate the amplifier means and probe means for amplifying signals from at least one of the probe means; and means for adjustably positioning the waveguide within the housing, so as to permit the orientation of the waveguide to correspond to the angle of polarization of incoming wave energy.

2. The invention as set forth in claim 1 above, wherein the system further includes a number of concentric side lobe suppressor rings about the input end of the waveguide.

3. The invention as set forth in claim 2 above, wherein the system includes means coupling the waveguide to the antenna, with the input end of the waveguide being at the focal region of the antenna.

4. A feed assembly for use with an antenna comprising:

a feed waveguide having an electrically open input end and a closed output end, and including orthogonally disposed internal ridges therein, the ridges being of diminishing height from the output end to the input end;

first and second probes, each disposed to extend through a wall of the waveguide and into the waveguide adjacent the output end thereof to transfer out wave energy in two orthogonally polarized planes corresponding to the positions of the internal ridges therein;

housing means disposed about the waveguide and coupled thereto, the housing means being spaced apart from the exterior of the waveguide to provide an enclosure for amplifier equipment;

amplifier equipment disposed within the housing means and including a first amplifier having an input directly connected to the first probe and a second amplifier having an input directly connected to the second probe;

means coupled to the housing and to the waveguide for providing adjustable securement of the waveguide at a given angle about a central axis of the waveguide relative to the position of the housing; and means disposed about the input end of the waveguide for suppressing side lobes.

5. The invention as set forth in claim 4 above, wherein the internal ridges have non-contacting maximum height sections within the waveguide at the output end thereof, and include transverse probe apertures and the first and second probes extending therethrough into the waveguide interior to provide couplings of wave energy from the interior of the waveguide to exterior electronic equipment.

6. A system for cooperation with a microwave antenna that receives signals in a group of channels, with the signals in adjacent channels being cross-polarized relative to each other, for passing amplified signals to associated processing equipment with low interference between the cross-polarized channels, comprising:

a waveguide feed coupled to the antenna and responsive to wave energy focused thereby, the waveguide feed comprising a circular cross-section waveguide having input and output ends disposed along a central axis, having means defining an electrical short across the output end and having internal orthogonally disposed ridge means mounted therein with decreasing height in a direction toward the input end to define orthogonal planes of preferred mode wave propagation;

a pair of probe means coupled to the waveguide feed, the probe means including first and second orthogonally disposed probes extending into the internal waveguide ridges to transmit wave energy from the waveguide with vertically polarized waves being transmitted by the first probe and horizontally polarized waves being transmitted by the second probe;

a housing disposed about the waveguide; and amplifier means mounted within the housing between the housing and the waveguide, the amplifier means comprising a pair of preamplifiers, each coupled to a different one of the detector probes, a single low noise amplifier, and switching means for selectively switching one of the preamplifiers to couple the signal therefrom to the input of the low noise amplifier.

* * * * *